United States Patent [19]

Bonnett

[11] 4,138,722

[45] Feb. 6, 1979

[54] ELECTRONIC AID FOR INHIBITING SMOKING

[76] Inventor: Robert N. Bonnett, 481 Yorkshire Dr., Severna Park, Md. 21146

[21] Appl. No.: 832,023

[22] Filed: Sep. 9, 1977

[51] Int. Cl.[2] ..... G06F 7/50; A24F 13/12

[52] U.S. Cl. ..... 364/415; 131/8 A; 131/171 A; 235/92 MT

[58] Field of Search ..... 364/770, 415; 235/92 MT; 131/8 A, 171 A

[56] References Cited

U.S. PATENT DOCUMENTS

| | | | |
|---|---|---|---|
| 3,654,449 | 4/1972 | Boyce | 364/709 X |
| 3,777,126 | 12/1973 | Hoff | 364/505 |
| 3,887,795 | 6/1975 | Eyrick et al. | 235/92 MT X |
| 4,058,714 | 11/1977 | Mostow | 364/754 |

*Primary Examiner*—David H. Malzahn

*Attorney, Agent, or Firm*—Scrivener, Parker, Scrivener & Clarke

[57] ABSTRACT

An aid for inhibiting smoking by providing a display of the total number of times a smoker draws in or inhales smoke during a smoking session. The display is provided by a pocket calculator having automatic constant features whereby the calculator can be adapted to operate as a digital counter responsive to a signal generated each time a smoker draws in on the tobacco or other product being smoked.

4 Claims, 2 Drawing Figures

ELECTRONIC AID FOR INHIBITING SMOKING

Figure 1:
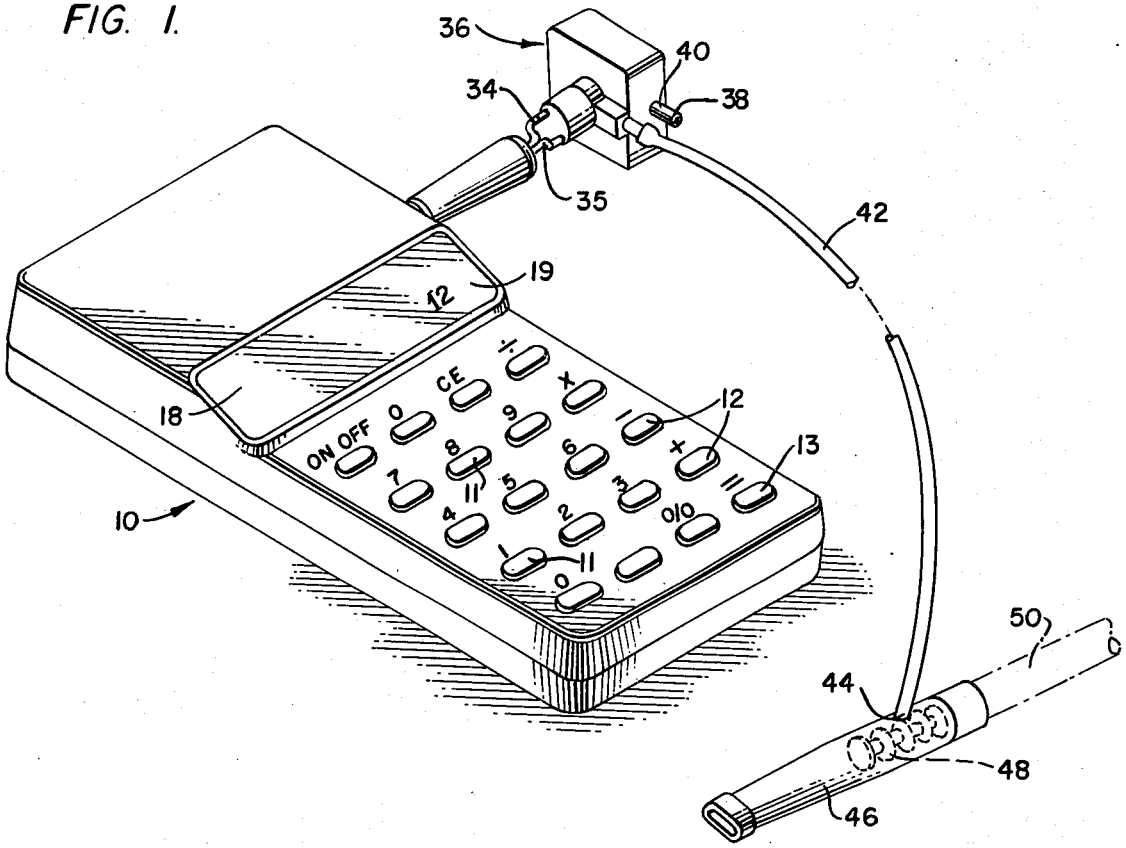

The present invention relates to aids for inhibiting smoking and more particularly is concerned with means for utilising calculator circuitry in calculators of the so-called "pocket" variety for indicating to a smoker the number of times he draws in on a smoker's product, such as a cigarette, during a smoking session.

As anyone knows who has smoked extensively, it is extraordinarily difficult to break the habit. Every smoker, however, knows that smoking may be hazardous to his health and devices are available which purport to aid a smoker in cutting down on his smoking and even stopping. A recent highly advertised system comprises the use of a series of filters each capable of filtering from smoke an increasing percentage of those products which are believed to cause smokers to become addicted to tobacco in the sense that the body chemistry has been so altered by prolonged smoking that any attempt to stop so upsets the balance established by smoking, that the stopping actually causes withdrawal symptoms which can only be alleviated by more smoking. It is believed that when the smoke products causing the altered body chemistry are slowly lessened by the above mentioned filtration system, the body chemistry balance will be shifted sufficiently far in a non-smoking direction so that the smoker can finally stop without undergoing withdrawal symptoms.

The present invention is based on the theory that a slow diminution in the intake of the smoke products causing addiction can be achieved without restricting the number of units, e.g. cigarettes, cigars, etc., smoked by providing a smoker who wants to quit with means whereby he can keep track of the number of times he draws in smoke during a smoking session. For most cigarette smokers this drawing in is known as inhalation whereby the smoke is inhaled into the lungs. For cigar and pipe smokers who usually do not inhale, the drawing in of smoke can still be harmful. It has been found of psycological help in lessening the number of draw-ins during each smoking session if the smoker is made aware of the actual number of times he does this for each cigarette, say. As he continues to smoke, he endeavors for each session to do better than last time until the smoke draw-ins or inhalations are sufficiently lessened or widely spaced that the body chemistry is slowly changed in the direction of a normal smoke-free balance until a point is reached where the smoker can finally stop entirely without suffering undue withdrawal symptoms.

Thus the main object of the invention is to provide counter means whereby a smoker can keep track of the total number of smoke draw-ins or inhalations during each smoking session.

More particularly it is an object of the invention to adapt calculator circuitry, particularly of the type found in so-called "pocket" calculators, as a counter which automatically totalises the number of smoke draw-ins or inhalations by a smoker during each smoking session.

Briefly the invention includes an auxiliary socket applied to an otherwise normal inexpensive, so-called "five function" calculator having an "automatic constant" feature, the latter being the ability to repeat a calculation upon each depression of the equals key following depression of a numerical key and a function key in the order prescribed by the calculator manufacturer.

The auxiliary socket is connected to the equals circuit of the calculator circuitry and when a pressure sensitive switch is plugged into the socket and arranged to respond to each smoke draw-in, the calculator totalises the number of draw-ins and displays this information to the smoker so that he is made aware of how often he has in fact drawn smoke into his system during a smoking session.

Figure 2:
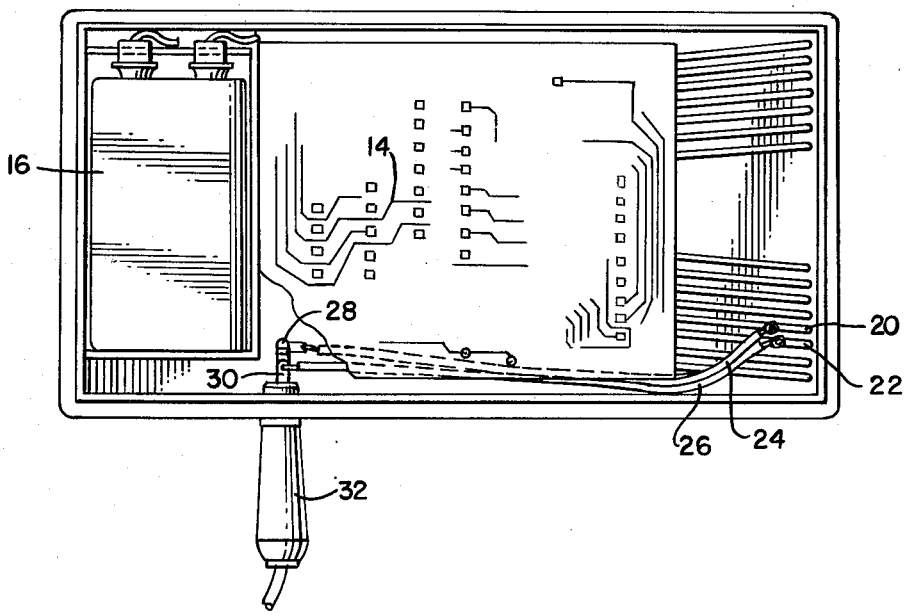

The invention will now be described in detail in conjunction with the accompanying drawings wherein:

FIG. 1 is a perspective view of a typical pocket calculator including apparatus for converting the calculator into a totaliser of the number of smoke draw-ins during a smoking session; and FIG. 2 is a plan view of the interior of the calculator of FIG. 1 showing the manner in which the signal produced by each smoke draw-in is fed into the calculator circuitry.

Referring now to the drawings, the numeral 10 designates broadly a typical, elemental, so-called "five function" electronic digital calculator of conventional construction and presently in widespread use. The calculator illustrated includes numerical keys or switches 11 corresponding to the numbers 0–9, function keys 12 for selecting the desired one of the five functions of the calculator (addition, subtraction, multiplication, division and percent) and an equals key or switch 13. When any selected key is depressed and its switch thereby closed, logic micro-circuitry in the calculator, designated generally by the numeral 14 in FIG. 2 and well known in the art is energised by an electrical source, such as a battery 16 shown, to produce in a known fashion by light emitting diodes or by flourescent display behind a window 18 a numerical display 19, represented by the number 12 in FIG. 1, corresponding to the keys or switches 11, 12, or 13 which have been depressed.

As mentioned above, for use as a counter the present invention requires calculator circuitry of the type having what is known as an "automatic constant" feature wherein a selected calculation, say addition, is repeated for each depression of the equals key 13 following depression of a numerical key, say 1, and a function key, say, addition, in the order prescribed by the manufacturer. For each depression of the equals key, under the just described presumed inputs, the display is increased by 1.

The present invention utilizes the inherent capacity of calculator circuitry having the described "automatic constant" feature for use as a counter of smoke draw-ins by a smoker as above described and to this end and in accordance with the invention there is connected into the equals circuit 20, 22, as shown in FIG. 2, a pair of leads 24, 26 leading to socket connections 28, 30 for a jack plug 32 connected by conductors 34, 35 to the posts of a known pressure sensitive switch 36. The switch 36 is responsive to differential pressure signals received through a pair of inlet ports 38 40 to operate on opposite sides of a diaphram (not shown) operable to close a normally open switch upon a relatively low level of differential pressure at the respective ports 38, 40.

The port 38 is open at all times to atmospheric pressure and the port 40 is connected by a flexible tube 42 to a port 44 leading to the interior of a cigar or cigarette holder 46. The latter may include a filter element 48 for filtering smoke from a cigarette or cigar 50 as the smoke is drawn into a smoker's mouth when he sucks on the holder. This sucking action partially evacuates the tube 42 and the chamber on one side of the diaphragm so that the latter is moved by atmospheric pressure to a position closing the switch and completing the equals circuit 20, 22 independently of the equals key 13. For monitoring the draw-ins from a pipe, a port for the tube 42 can be provided in the pipe stem.

Upon each completion of the equals circuit following "programming" of the calculator for an automatic constant of 1, that is to say upon each draw-in to his system of smoke by a smoker, the display is increased by 1 and upon the completion of the smoking session the smoker will have before him an accurate display of the total number of times he has drawn in or inhaled smoke.

It can be seen that the jack plug 32 can be readily removed at any time so that the calculator can be used for its conventional purpose. By the same token, the jack plug can be easily inserted by a smoker each time he wishes to smoke so that he can strive to have less and less smoke draw-ins per session until eventually he is sufficiently "detoxified" from those smoke products causing physical addiction that he can stop smoking altogether with minimum withdrawal symptoms.

The invention contemplates kits within its perview which may be sold separately from an "automatic constant" type of calculator whereby the calculator can be adapted to use as a smoking inhibiter as above described.

It will be readily apparent that the invention is susceptible of a variety of changes and modifications without, however, departing from the scope and spirit of the appended claims.

What is claimed is:

1. An aid for inhibiting smoking comprising electronic calculator circuitry including a changeable display and repetitively operable switch means, said circuitry being programmed that upon each operation of the switch means the display is changed by a predetermined constant amount, means directly responsive to a smokers draw-in of smoke from an inhaled smokers product for generating a signal, and means for operating said switch means in response to each generated signal.

2. An aid for inhibiting smoking by displaying to a smoker the number of smoke draw-ins during a smoking session comprising electronic calculator circuitry having at least a numerical input circuit representing the number 1, an equals circuit, at least one function circuit for addition calculations, switch means in each of said circuits, and changeable display means responsive to the closing of the switch means of said circuits in predetermined order, said circuitry including an automatic constant feature whereby a display is changed automatically by the number of the numerical input circuit upon each completion of the equals circuit following completion of the function and numerical input circuits in a prescribed order which provides said automatic constant feature, in combination therewith signal responsive switch means external to said calculator circuitry, other circuit means connecting said signal responsive switch means into said equals circuit in parallel with the switch means thereof, means for generating a signal each time a smoker draws-in smoke from an ignited smoker's product, and means for transmitting the signal to said signal responsive switch means to close the same and complete said equals circuit following completion of said numerical input and function circuits in prescribed order to provide said automatic constant feature whereby the total number of draw-ins by the smoker during a smoking session is displayed by the display means of said circuitry.

3. The combination of claim 2 wherein said calculator circuitry is located in a portable case defining a pocket calculator, said other circuit means including socket means leading into said case and having terminals connected to said equals circuit in parallel with the switch means thereof, said other circuit means also including plug means selectively insertable into said socket means and having terminals connected to said signal responsive switch means whereby said calculator is selectively useable by a smoker for totalising the number of draw-ins during a smoking session.

4. The combination of claim 2 wherein said signal responsive switch means is normally open and closes in response to pressure differential signals, said signal generation means being a holder for the smoker's product, and the signal transmitting means being a tube extending between said holder and said switch means whereby upon each draw-in a differential pressure signal is transmitted to the switch means to close the same.

* * * * *